US010118215B2

(12) United States Patent
Gaertner et al.

(10) Patent No.: US 10,118,215 B2
(45) Date of Patent: Nov. 6, 2018

(54) BLIND RIVET SETTING DEVICE AND METHOD FOR SETTING A BLIND RIVET

(71) Applicant: GESIPA BLINDNIETTECHNIK GMBH, Moerfelden-Walldorf (DE)

(72) Inventors: Richard Gaertner, Moerfelden-Walldorf (DE); Lothar Wille, Moerfelden-Walldorf (DE); Thomas Bamberger, Moerfelden-Walldorf (DE)

(73) Assignee: GESIPA BLINDNIETTECHNIK GMBH, Moerfelden-Walldorf (DE)

( * ) Notice: Subject to any disclaimer, the term of this patent is extended or adjusted under 35 U.S.C. 154(b) by 201 days.

(21) Appl. No.: 14/803,742

(22) Filed: Jul. 20, 2015

(65) Prior Publication Data

US 2016/0045950 A1 Feb. 18, 2016

(30) Foreign Application Priority Data

Aug. 15, 2014 (EP) ..... 14181124

(51) Int. Cl.
*B21J 15/28* (2006.01)
*B21J 15/26* (2006.01)
(Continued)

(52) U.S. Cl.
CPC ..... *B21J 15/28* (2013.01); *B21J 15/043* (2013.01); *B21J 15/105* (2013.01); *B21J 15/26* (2013.01); *B21J 15/285* (2013.01)

(58) Field of Classification Search
CPC ..... B21J 15/043; B21J 15/105; B21J 15/26; B21J 15/28; B21J 15/285;
(Continued)

(56) References Cited

U.S. PATENT DOCUMENTS 5,473,805 A 12/1995 Wille
5,666,710 A * 9/1997 Weber ..... B21J 15/105 227/2
(Continued)

FOREIGN PATENT DOCUMENTS

CN 1950159 4/2007
CN 102688973 9/2012
(Continued)

OTHER PUBLICATIONS

Translation of DE102005054048, generated Jun. 29, 2018.*
(Continued)

*Primary Examiner* — Matthew P Travers
(74) *Attorney, Agent, or Firm* — Greenblum & Bernstein, P.L.C.

(57) ABSTRACT

Blind rivet setting device and method. The blind rivet setting device includes a housing; a pulling mechanism arranged in the housing; an electric motor structured and arranged move the pulling mechanism in a pulling direction out of a rivet receiving position; a control device, which is structured and arranged to control the motor, including a tear-off detection device that generates a mandrel tear-off signal when a pulling mandrel is torn off; and an operating device that is connected to the control device. When the mandrel tear-off signal is generated, the control device stops the driving of the pulling mechanism in the pulling direction.

17 Claims, 1 Drawing Sheet

(51) Int. Cl.
*B21J 15/04* (2006.01)
*B21J 15/10* (2006.01)

(58) Field of Classification Search
CPC .... Y10T 29/49956–29/49957; Y10T 29/5303; Y10T 29/53065; Y10T 29/5377
See application file for complete search history.

(56) References Cited

U.S. PATENT DOCUMENTS

| | | | | |
|---|---|---|---|---|
| 6,237,390 | B1 | 5/2001 | Honsel et al. | |
| 6,240,613 | B1 * | 6/2001 | O'Connor | B21J 15/043 29/243.523 |
| 2002/0166221 | A1 * | 11/2002 | Clew | B21J 15/025 29/407.02 |
| 2004/0063362 | A1 * | 4/2004 | Weeks | B21J 15/105 439/894 |
| 2006/0230591 | A1 * | 10/2006 | Chitty | B21J 15/28 29/243.523 |
| 2011/0239449 | A1 * | 10/2011 | Masugata | B21J 15/043 29/715 |
| 2015/0040373 | A1 * | 2/2015 | Chen | B21J 15/02 29/525.06 |

FOREIGN PATENT DOCUMENTS

| | | | | |
|---|---|---|---|---|
| CN | 202 539 457 | | 11/2012 | |
| DE | 41 26 602 | | 2/1993 | |
| DE | 102005054048 | A1 * | 5/2007 | B21J 15/043 |
| EP | 0 572 819 | | 12/1993 | |
| EP | 0 594 333 | | 4/1994 | |
| EP | 0 953 390 | | 11/1999 | |
| EP | 2 719 482 | | 4/2014 | |
| WO | 2013/180769 | | 12/2013 | |

OTHER PUBLICATIONS

China Office Action conducted in counterpart China Appln. No. 201510354594.0 (dated Dec. 30, 2016) (w/ English language translation).

European Office Action conducted in European Appln. No. 14 181 124.0-1702 (dated Feb. 2, 2015) (w/ English language translation).

China Office Action conducted in counterpart China Appln. No. 201510354594.0 (dated Mar. 6, 2018) (w/ English language translation).

* cited by examiner

BLIND RIVET SETTING DEVICE AND METHOD FOR SETTING A BLIND RIVET

CROSS-REFERENCE TO RELATED APPLICATIONS

The present application claims priority under 35 U.S.C. § 119 of European Patent Application No. 14 181 124.0, filed Aug. 15, 2014, the disclosure of which is expressly incorporated by reference herein in its entirety.

BACKGROUND OF THE EMBODIMENTS

1. Field of the Invention

Embodiments of the invention relate to a blind rivet setting device having a housing, a pulling mechanism in the housing, an electric motor with which the pulling mechanism can be moved out of a rivet receiving position in a pulling direction, a control device for controlling the motor, and an operating device that is connected to the control device.

Furthermore, embodiments of the invention relate to a method for setting a blind rivet in which an electric motor controlled by a control device moves a pulling mechanism out of a rivet receiving position in a pulling direction when an operating device is actuated.

2. Discussion of Background Information

A blind rivet setting device of this type is known, for example, from DE 41 26 602 C2, the disclosure of which is expressly incorporated by reference herein in its entirety. There, the electric motor is embodied or formed so that it is reversible.

During the setting of a blind rivet, the pulling mandrel of the blind rivet is inserted into the pulling mechanism of the blind rivet setting device. For this purpose, the pulling mechanism is located in a rivet receiving position in which it is opened far enough so that the rivet mandrel can be inserted. When the blind rivet has then been inserted in the item that is to be joined, the operator can actuate the operating device. In many cases, the operating device is embodied or formed as a pressure switch. The setting operation is then started by a pressing of the pressure switch. The pulling mechanism is moved out of the rivet receiving position, namely, in the pulling direction. As a result, the shank of the blind rivet is deformed on the "blind" side of the item being joined and forms a closing head there. If the pulling mechanism is moved further, the pulling mandrel tears off at some point. The operator then releases the pressure switch. The motor stops and moves the pulling mechanism back into the rivet receiving position. Depending on the operator's reaction speed, a more or less lengthy overrun time occurs after the mandrel is torn off or broken.

In some cases, the operator must set a large number of blind rivets in an identical or similar manner. Here, a habituation effect sets in after a relatively short time. The operator no longer waits for the audible mandrel breakage, but rather releases the pressure switch based on a feel for timing. In this case, it often occurs that the pressure switch is released too early and the pulling mandrel is not yet torn off. This results in the necessity of repeating the rivet setting operation after the return travel. This costs time and energy, which is disadvantageous, particularly for battery operated blind rivet setting devices.

SUMMARY OF THE EMBODIMENTS

Embodiments of the invention optimize the setting operation of a blind rivet with regard to speed and energy consumption.

Accordingly, a blind rivet setting device of the type named at the outset includes a control device having a tear-off detection device that generates a mandrel tear-off signal when a pulling mandrel is torn off. The control device stops the driving of the pulling device in the pulling direction when the mandrel tear-off signal appears.

For a blind rivet setting device of this type, the motor is therefore only actuated for as long as this is necessary. Once the mandrel is torn off, a further operation of the motor to move the pulling mechanism in the pulling direction is no longer necessary. The recognition of the corresponding state necessary therefore takes place automatically via the tear-off detection device, which means that the corresponding information no longer needs to be acquired and processed by the operator. Since the human reaction time is omitted in this case, a certain time savings can be observed. Also omitted is the risk that the operator interrupts the setting operation too early and that the setting operation must be repeated. This, too, would unnecessarily cost energy and time.

Preferably, the control device decelerates the motor while energy is recovered. This is particularly advantageous for battery operated blind rivet setting devices, since not only is time saved, but also the kinetic energy present in the pulling mechanism and in the motor can be converted back into electric energy.

It is also advantageous if the control device reverses the motor when the mandrel tear-off signal appears and moves the pulling mechanism counter to the pulling direction. The pulling mechanism is thus moved in the direction of the rivet receiving position again, so that virtually no time is lost for this movement as well.

In a first preferred embodiment, the control device moves the pulling mechanism all the way into the rivet receiving position. In the rivet receiving position, the pulling mechanism is open and the torn-off pulling mandrel can fall out. Since the movement into the rivet receiving position begins immediately following the tearing-off of the pulling mandrel, essentially the shortest possible cycle time is achieved for the blind rivet setting operation.

In a second preferred embodiment, the control device moves the pulling mechanism all the way into a position outside of the rivet receiving position. If the pulling mechanism is moved all the way into the rivet receiving position, it is opened such that the pulling mandrel can fall out of the blind rivet setting device. This can lead to problems if a riveting task is present in which riveting must occur in a downward direction. In this case, the pulling mandrel that falls out can cause problems in terms of work safety, the risk of a short circuit for electric subassemblies, loose rivet mandrels in the component, etc. However, if the pulling mechanism is stopped before it has reached the rivet receiving position, then the pulling mandrel remains in the blind rivet setting device. The blind rivet setting device can then be moved into a position in which a controlled disposal of the pulling mandrel is possible. If the blind rivet setting device is, for example, provided with a mandrel collecting container at its back end, then the blind rivet setting device can be pointed upwards at an incline, and the pulling mechanism can be moved into the rivet receiving position by a further actuation of the operating device so that the pulling mandrel can fall back into the mandrel collecting container.

In a particularly preferred embodiment, the tear-off detection device comprises a current monitoring device which constantly ascertains a current fed to the motor and which generates the mandrel tear-off signal when the current, after reaching a maximum value, drops at least by a predetermined percentage of the maximum value. When the pulling mandrel is moved by the pulling mechanism, the force necessary for moving the pulling mandrel, and therefore the torque of the motor necessary for producing the force, increases. This is caused by the formation of the closing head of the rivet sleeve due to the movement of the pulling mandrel. When the closing head is formed and a further movement of the pulling mandrel is virtually no longer possible, the force increases to such an extent that the pulling mandrel tears off Once the pulling mandrel is torn off, the force drops to a minimum value within a very short period of time and, as a result, so does the torque that must be produced by the motor and, along with it, the current drawn by the motor. This drop in current can be monitored and detected in a relatively simple and reliable manner. In some setting operations, intermediate maxima of the current draw occur, for example, when the pulling mandrel slips into the rivet sleeve. However, it can be prevented that a tearing-off of the mandrel is erroneously detected in this case in that the predetermined percentage of the maximum value is appropriately selected.

Here, it is preferred that the predetermined percentage is equal to 30%. The predetermined percentage can also be selected such that it is larger, for example, 40%, 50%, 60%, 70%, or 80%. A reliable detection of a mandrel tear-off is thus possible.

Preferably, the operating device transmits, depending on different actuation modes, at least two different actuation signals to the control device. The operator can thus specify, for example, whether the pulling mechanism is to be moved all the way into the rivet receiving position after the mandrel tear-off, or whether it is to be stopped abruptly before the rivet receiving position, that is, immediately before the impact of the chuck jaws of the pulling device on the nose piece, in order to prevent a falling-out of the pulling mandrel. This occurs in order to shorten the subsequent process time. The different actuation modes can, for example, be embodied or formed so that the operating device is actuated briefly, for example, a pressure switch is briefly pressed, in a first actuation mode and the operating device is continuously actuated, that is, a pressure switch is pressed and held continuously, in a second actuation mode.

Moreover, a method of the type named at the outset includes that, when a pulling mandrel is torn off, a mandrel tear-off signal is automatically generated, as a result of which the control device stops the driving of the pulling mechanism in the pulling direction.

Thus, if the mandrel tears off, then the control device controls the motor such that the pulling mechanism is no longer moved. The pulling mechanism is thus only moved up until the mandrel tear-off, so that unnecessary movements are avoided. This saves energy and time.

Preferably, the motor is decelerated and energy recovered when the mandrel tear-off signal appears. Since the mandrel tear-off signal reliably indicates the tearing-off of the pulling mandrel without an intervention by the operator being necessary, the energy stored in the motor and in the pulling mechanism can be converted back into electric energy again immediately following the mandrel tear-off, which is advantageous, particularly for blind rivet setting devices operated by battery or storage battery.

Preferably, the direction of movement of the pulling mechanism is altered when the mandrel tear-off signal appears. This also saves time. Immediately following the tearing-off of the pulling mandrel, the pulling mechanism is once again moved in the direction of the rivet receiving position.

Here, it is preferred in a first embodiment that the pulling mechanism is moved all the way into the rivet receiving position. In this case, the pulling mandrel can then fall out of or be removed from the pulling mechanism.

In an alternative embodiment, it can be provided that the pulling mechanism is moved into a position directly before the rivet receiving position. In this manner, it is prevented that the pulling mandrel falls out of the blind rivet setting device, which, as described above, can lead to problems.

Preferably, the current draw of the motor is monitored to generate the mandrel tear-off signal, and the mandrel tear-off signal is generated when the current, after reaching a maximum value, drops by at least a predetermined percentage of the maximum value. As explained above, the current draw is a parameter that allows the torque produced by the motor to be detected. This torque is in turn a measure of the force with which the pulling mechanism acts on the pulling mandrel. If the mandrel tears off, then this force drops to zero virtually immediately, which can be detected without difficulty from a corresponding drop in the current drawn by the motor, for example, at a no-load level.

Preferably, the operating device can be actuated in at least two different actuation modes and transmits a different signal to the control device in each actuation mode. If, for example, the operator briefly actuates the operating device, then the control device reverses the motor when the mandrel tear-off signal appears and causes the pulling mechanism to be moved all the way into the rivet receiving position. If, on the other hand, the operator continuously actuates the operating device, then this is a signal that although the control device is to reverse the motor when the mandrel tear-off signal appears, the pulling mechanism is not to move all the way into the rivet receiving position, but is rather to stop before the rivet receiving position so that the pulling mandrel cannot fall out of the blind rivet setting device. The return travel then occurs after the switch is released, for example.

Embodiments are directed to a blind rivet setting device that includes a housing; a pulling mechanism arranged in the housing; an electric motor structured and arranged move the pulling mechanism in a pulling direction out of a rivet receiving position; a control device, which is structured and arranged to control the motor, including a tear-off detection device that generates a mandrel tear-off signal when a pulling mandrel is torn off; and an operating device that is connected to the control device. When the mandrel tear-off signal is generated, the control device stops the driving of the pulling mechanism in the pulling direction.

According to embodiments, the control device can be structured and arranged to decelerate the motor while energy is recovered. When the mandrel tear-off signal is generated, the control device can be structured and arranged to reverse the motor and to move the pulling mechanism counter to the pulling direction. The control device may be structured and arranged to move the pulling mechanism all the way into the rivet receiving position. The control device can be structured and arranged to move the pulling mechanism all the way into a position outside of the rivet receiving position. Further, the position outside of the rivet receiving portion can be a position immediately before the pulling mechanism opens.

In accordance with other embodiments, the tear-off detection device can include a current monitor structured and arranged to constantly ascertain a current fed to the motor and to generate the mandrel tear-off signal when the current, after reaching a maximum value, drops at least by a predetermined percentage of the maximum value. The predetermined percentage can be 30%.

In other embodiments, the operating device may be structured and arranged to transmit at least two different actuation signals to the control device depending on different actuation modes.

Embodiments of the invention are directed a method for setting a blind rivet that includes actuating an operating device to move, via a controlled electric motor, a pulling mechanism in a pulling direction out of a rivet receiving position. Further, when a pulling mandrel is torn off, the method further includes automatically generating a mandrel tear-off signal so the control device stops the moving of the pulling mechanism in the pulling direction.

According to embodiments, when the mandrel tear-off signal is generated, the method further can include decelerating the motor and recovering energy. When the mandrel tear-off signal is generated, the method may further include altering the direction of movement of the pulling mechanism. The method can also include moving the pulling mechanism all the way into the rivet receiving position. Further, the method may include moving the pulling mechanism into a position outside of the rivet receiving position. The position outside of the rivet receiving position may be a position immediately before the pulling mechanism opens.

In other embodiments, the method can include monitoring the current draw of the motor to generate the mandrel tear-off signal and generating the mandrel tear-off signal when, after reaching a maximum value, the current drops by at least a predetermined percentage of the maximum value.

In accordance with still yet other embodiments of the present invention, the operating device can be actuatable in at least two different actuation modes and transmits a different signal to the control device in each actuation mode.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS

Figure 1:
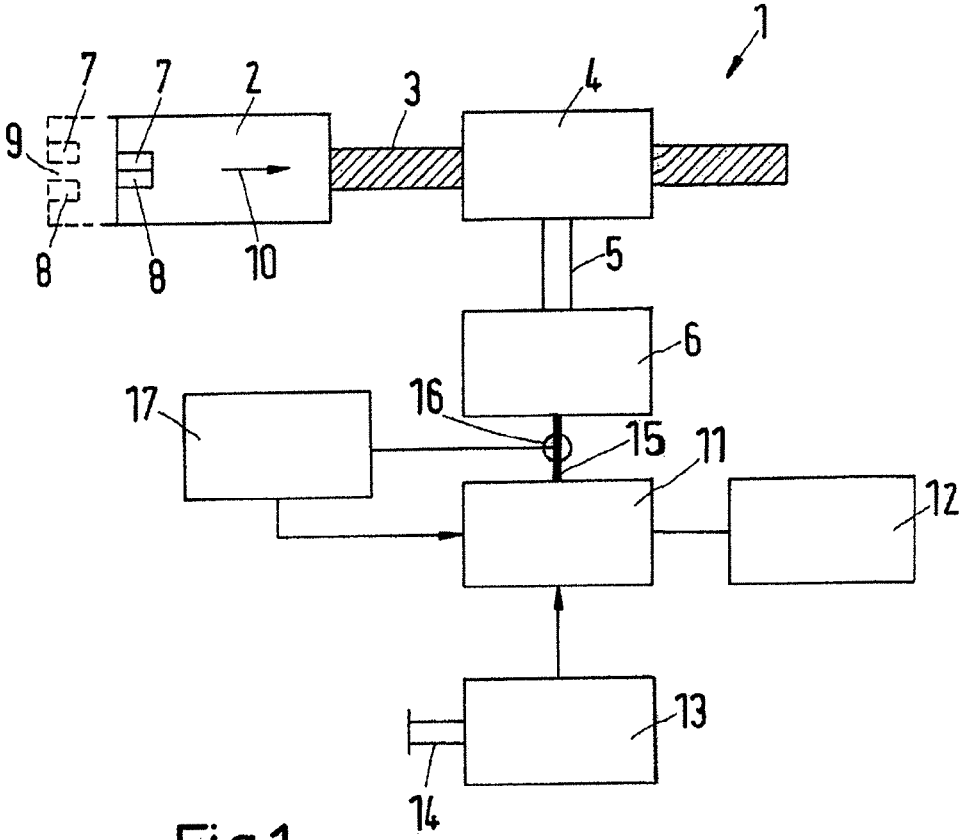
FIG. 1 shows a highly schematized view of essential functional elements of a blind rivet setting device.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The mechanical structure of a blind rivet setting device is described in DE 41 26 602 C2, the disclosure of which is expressly incorporated by reference herein in its entirety. For this reason, only those functional elements which are essential for understanding the present invention are explained below.

A blind rivet setting device 1 comprises a housing, not illustrated in greater detail, in which a pulling mechanism is arranged. The pulling mechanism comprises a clamping jaws arrangement 2 which is connected to a hollow threaded spindle 3. The threaded spindle 3 is engaged with a gearing device 4. The gearing device 4 is connected to a reversible electric motor 6 via a transmission element 5.

The clamping jaws arrangement comprises multiple clamping jaws 7, 8 which are closed, that is, pressed against one another by a certain force, in a setting operation of a blind rivet, not illustrated in greater detail, in order to grasp a pulling mandrel of the blind rivet and apply a pulling force thereto. This closed state of the clamping jaws arrangement 2 is illustrated by solid lines. However, the clamping jaws arrangement 2 can also be moved into a rivet receiving position, illustrated by dashed lines, in which the clamping jaws 7, 8 are open and form a receiving opening 9 for the rivet mandrel.

From this rivet receiving position, the clamping jaws arrangement 2 can be moved in a pulling direction 10, illustrated by an arrow, when the motor 6 acts on the clamping jaws arrangement 2 via the gearing device 4 and the threaded spindle 3.

The motor 6 is connected to a control device 11. The control device 11 receives electric energy from a battery 12, which can also be embodied or formed as a rechargeable battery or storage battery. The control device 11 is also connected to an operating device 13 which comprises, e.g., a pushbutton or a pressure switch 14.

The control device 11 feeds the electric motor 6 energy in the form of electric current via a feed line 15. In the feed line 15 (or in a different position) in the control device 11, a current sensor 16 is arranged which forms part of a tear-off detection device 17. Here, the current sensor 16 and the tear-off detection device 17 are illustrated as discrete elements. However, they can also be a component of the control device 11.

Figure 2:
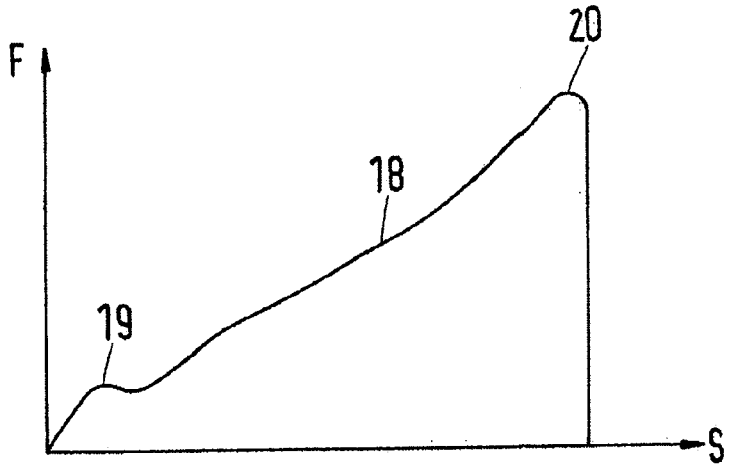
FIG. 2 shows a highly schematized progression of the force over the distance during the setting of the blind rivet.

FIG. 2 shows, in schematic form, the progression of the force F over the distance s that the clamping jaws arrangement 2 travels in a setting operation of a blind rivet. A function 18 is illustrated. From the function 18, it follows that the force initially increases during the setting of a blind rivet. In many cases, there then occurs an intermediate maximum 19 when the pulling mandrel slips into the rivet sleeve. The force then continues to increase, which can be attributed to the pulling mandrel forming the closing head on the rivet sleeve. The force subsequently continues to increase up to a maximum 20 and then drops off abruptly when the pulling mandrel tears off. The tear-off detection device 17 continuously monitors the current with the aid of the current sensor 16 (or in a different manner) and detects the maximum 20 not only in that it registers a maximum generally, but rather in that it checks whether the current, after reaching the maximum value 20, drops by a predetermined percentage of the maximum value. This predetermined percentage can be equal to 50%, for example. The drop must occur, for instance, in a section of the distance s which is smaller than 1 mm, preferably smaller than 0.5 mm. It is thus eliminated, with high certainty, that the tear-off detection device 17 incorrectly identifies the intermediate maximum 19 as the maximum 20.

The force, the progression 18 of which is illustrated in FIG. 2, is produced by a torque of the motor 6 via the gearing device 4. The current draw of the motor 6 correlates sufficiently with the torque, meaning that if the torque increases, then the current draw of the motor 6 also increases. The maximum value 20 of the force F can thus be ascertained with sufficient accuracy by a corresponding maximum of the drawn current. In the same manner, the decrease in force illustrated in FIG. 2 can be detected from a drop or a decrease in the current draw.

The tear-off detection device 17 immediately relays the detection of the mandrel tear-off to the control device 11. The control device 11 subsequently stops the driving of the clamping jaws arrangement 2 in the direction of pull 10. Advantageously, the control device 11 decelerates the motor 6 while energy is recovered. The energy gained thereby is fed back into the battery 12. This has two advantages. On the one hand, energy is recovered. On the other hand, through the deceleration of the motor 6, less time is lost.

Once the motor 6 has reached its idle state, the control device 11 reverses the motor 6 so that the clamping jaws arrangement 2 is moved counter to the pulling direction 10. Alternatively, the motor 6 can also simply remain idle.

This movement can extend all the way into the rivet receiving position illustrated by dashed lines, in which the clamping jaws 7, 8 are moved away from one another so that the torn-off rivet mandrel is released. This is then the shortest possible cycle time, since the clamping jaws arrangement 2 is, after the completion of the setting operation, immediately available again in a position in which it can receive a new rivet mandrel.

In some situations, however, it may be disadvantageous to move the clamping jaws arrangement 2 into the rivet receiving position, for example, when the blind rivet setting device is held in a downward direction during the riveting. In this case, the torn-off pulling mandrel could fall out of the receiving opening 9 and damage the item that is to be joined, or cause problems in another way, for example, causing a risk of a short circuit for electrical subassemblies or rattling noises if the rivet mandrel loosely lies around in a component in an uncontrolled manner.

In this case, the clamping jaws arrangement 2 is not moved all the way into the rivet receiving position, but rather into the position illustrated by solid lines which is outside of the rivet receiving position. This position is, for example, defined such that the clamping jaws arrangement 2 must only travel a short distance in order to open the clamping jaws 7, 8.

In a manner not illustrated in greater detail, a mandrel collecting container that receives the torn-off pulling mandrels can also be provided at the end of the threaded spindle 3 facing away from the clamping jaws arrangement 2.

The different end positions of the clamping jaws arrangement 2 can then be selected by an actuation of the pressure switch 14.

If the pressure switch 14 is only actuated briefly, the control device 11 starts the setting operation and, with the aid of the motor 6, moves the clamping jaws arrangement 2 in the pulling direction up until the tearing-off of the pulling mandrel, which is detected as a result of the maximum 20 being reached. The clamping jaws arrangement 2 is then moved counter to the pulling direction 10 back into the rivet receiving position again and the clamping jaws 7, 8 are opened.

If the pressure switch 14 is pressed continuously, however, then the clamping jaws arrangement 2 is moved up until the tearing-off or breaking of the pulling mandrel and then moved back into the position shortly before the rivet receiving position. The clamping jaws arrangement 2 is only moved back into the rivet receiving position when the operator releases the pressure switch 14. The operator can thus independently decide when the pulling mandrel is to be disposed of.

It is also possible to leave the clamping jaws arrangement 2 in place in the attained position after the tearing-off of the pulling mandrel and to allow the resetting operation of the clamping jaws arrangement 2 into the rivet receiving position to begin later altogether. Here, the resetting operation of the clamping jaws arrangement 2 can also be initialized by a release of the pressure switch 14, for example.

Of course, the different operating states can also be set up in a different manner, for example, by providing an additional reversing switch.

If no rivet has been received in the blind rivet setting device and the setting operation is nevertheless started, it is also not possible for a drop in the maximum current to take place. The clamping jaws arrangement 2 is then, for example, moved into the back end position, which corresponds to the maximum stroke, and remains in place after reaching the back end position without the clamping jaws arrangement 2 being moved back into the rivet receiving position. Only after a release or renewed actuation of the switch 14 is the return travel into the rivet receiving position started.

The current sensor 16 can, as explained above, also be a component of the control device 11. It can also be arranged between the control device 11 and the battery 12.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A blind rivet setting device comprising:

a housing;

a pulling mechanism arranged in the housing;

an electric motor structured and arranged to move the pulling mechanism in a pulling direction out of a rivet receiving position;

a control device, which is structured and arranged to control the motor, comprising a tear-off detection device that monitors current or electric power drawn by the motor to generate a mandrel tear-off signal when a pulling mandrel is torn off; and an operating device that is connected to the control device;

wherein, when the mandrel tear-off signal is generated, the control device is configured to stop the driving of the pulling mechanism in the pulling direction, and wherein the tear-off detection device comprises a current monitor structured and arranged to constantly ascertain a current fed to the motor, which includes a maximum value and an intermediate maximum occurring prior to the maximum value, and to generate the mandrel tear-off signal only when the current, after reaching the maximum value, drops at least by a predetermined percentage of the maximum value within a pulling movement of less than 1 mm, whereby the tear-off detection device does not detect the intermediate maximum as the maximum value.

2. The blind rivet setting device according to claim 1, wherein the control device is structured and arranged to decelerate the motor while energy is recovered.

3. The blind rivet setting device according to claim 2, wherein, when the mandrel tear-off signal is generated, the control device is structured and arranged to reverse the motor and to move the pulling mechanism counter to the pulling direction.

4. The blind rivet setting device according to claim 3, wherein the control device is structured and arranged to move the pulling mechanism all the way into the rivet receiving position.

5. The blind rivet setting device according to claim 3, wherein the control device is structured and arranged to move the pulling mechanism all the way into a position outside of the rivet receiving position.

6. The blind rivet setting device according to claim 5, wherein the position outside of the rivet receiving portion is a position immediately before the pulling mechanism opens.

7. The blind rivet setting device according to claim 1, wherein the predetermined percentage is 30%.

8. The blind rivet setting device according to claim 1, wherein the operating device is structured and arranged to transmit at least two different actuation signals to the control device depending on different actuation modes.

9. A method for setting a blind rivet using the blind rivet setting device of claim 1 comprising:

actuating the control device to move, via the controlled electric motor, the pulling mechanism in the pulling direction out of the rivet receiving position;

wherein, when a pulling mandrel is torn off, the method further comprises automatically generating a mandrel tear-off signal so the control device stops the moving of the pulling mechanism in the pulling direction.

10. The method according to claim 9, wherein, when the mandrel tear-off signal is generated, the method further comprises decelerating the motor and recovering energy.

11. The method according to one of claim 10, wherein, when the mandrel tear-off signal is generated, the method further comprises altering the direction of movement of the pulling mechanism.

12. The method according to claim 11, further comprising moving the pulling mechanism all the way into the rivet receiving position.

13. The method according to claim 11, further comprising moving the pulling mechanism into a position outside of the rivet receiving position.

14. The method according to claim 13, wherein the position outside of the rivet receiving position is a position immediately before the pulling mechanism opens.

15. The method according to claim 9, further comprising monitoring a current draw of the motor to generate the mandrel tear-off signal and generating the mandrel tear-off signal when, after reaching a maximum value, the current drops by at least a predetermined percentage of the maximum value.

16. The method according to claim 9, wherein the operating device is actuatable in at least two different actuation modes and transmits a different signal to the control device in each actuation mode.

17. A blind rivet setting device, comprising:

an electric motor;

a pulling mechanism;

a control device to move, via the electric motor, the pulling mechanism in a pulling direction out of a rivet receiving position, wherein, only when a predetermined percentage drop from a maximum current drawn by the electric motor occurs within a pulling movement of less than 1 mm, which is indicative of a pulling mandrel being torn off, the control device is configured to stop moving of the pulling mechanism in the pulling direction and the electric motor is decelerated to recover energy.

* * * * *